US012577803B1

(12) United States Patent
Haskins

(10) Patent No.: US 12,577,803 B1
(45) Date of Patent: Mar. 17, 2026

(54) QUICK INSTALL ANGLE-ADJUSTABLE POST HOLDER WITH SUPPORTING SOIL SCREWS

(71) Applicant: Thomas Ellis Stanley Haskins, Holbrook, MA (US)

(72) Inventor: Thomas Ellis Stanley Haskins, Holbrook, MA (US)

( * ) Notice: Subject to any disclaimer, the term of this patent is extended or adjusted under 35 U.S.C. 154(b) by 215 days.

(21) Appl. No.: 18/389,389

(22) Filed: Nov. 14, 2023

Related U.S. Application Data

(63) Continuation-in-part of application No. 17/128,448, filed on Dec. 21, 2020, now Pat. No. 11,787,024.

(51) Int. Cl.
*E04H 17/22* (2006.01)
*E02D 5/80* (2006.01)
*E04H 12/22* (2006.01)

(52) U.S. Cl.
CPC ..... *E04H 17/22* (2013.01); *E02D 5/801* (2013.01); *E04H 12/2238* (2013.01); *E04H 12/2269* (2013.01)

(58) Field of Classification Search
CPC . E04H 17/22; E04H 12/2284; E04H 12/2269; E04H 12/22
USPC ..... 52/157
See application file for complete search history.

(56) References Cited

U.S. PATENT DOCUMENTS 695,663 A * 3/1902 Weirich ..... G09F 17/00 211/172
1,645,747 A * 10/1927 Fry ..... B66C 23/66 212/232
3,402,961 A * 9/1968 Larson ..... B60P 3/32 403/59
3,655,160 A * 4/1972 Grillot ..... A63B 71/02 403/68
3,848,367 A * 11/1974 Barnes ..... B60P 3/36 52/157
6,871,455 B1 * 3/2005 Cockman ..... E02D 5/801 52/165
7,624,545 B2 * 12/2009 Turley ..... E02D 5/80 52/156
8,875,451 B1 * 11/2014 Parduhn ..... E04H 12/2223 52/165
2012/0131879 A1 * 5/2012 Bergman ..... E04F 11/1812 52/704

(Continued)

*Primary Examiner* — Paola Agudelo

(57) ABSTRACT

The herein referenced innovative technology is a quick-install, multi-angle adjustable post holder with supporting soil screws that enables a user to install said post very quickly and even uninstall, move and reinstall very quickly without any digging or concrete work and on a wide variety of angles of ground surfaces. Said post holder includes a generally rigid base with holes to receive post holder stabilization and retention soil screws that are screwed through said holes into a ground surface and which keep said base fixed to the ground and having two or more adjustable and lockable pivoting clamps, a first and upper of which clamps onto and holds said post to said clamp and is adjustable infinitely within a possible 180 degrees which clamp is attached to a second and lower adjustable and lockable pivoting clamp that is adjustable infinitely within a possible 180 degrees perpendicular to said 1$^{st}$ clamp adjustable angles and which is attached to said a top of post holder base.

4 Claims, 8 Drawing Sheets

(56) References Cited

U.S. PATENT DOCUMENTS

| | | | | |
|---|---|---|---|---|
| 2015/0247336 | A1* | 9/2015 | Bergman | E02D 27/42 52/157 |
| 2016/0017564 | A1* | 1/2016 | Wellens | E04H 12/22 405/232 |
| 2017/0016243 | A1* | 1/2017 | Testa | E04H 12/2253 |
| 2017/0189736 | A1* | 7/2017 | Martin | E04H 12/22 |
| 2020/0362636 | A1* | 11/2020 | Fjelde | E02D 27/42 |
| 2023/0313554 | A1* | 10/2023 | Pilon | E04H 12/2284 248/534 |

* cited by examiner

QUICK INSTALL ANGLE-ADJUSTABLE POST HOLDER WITH SUPPORTING SOIL SCREWS

This invention has a multifold purpose as follows:

1. To provide a fence post holder base that is
   a. quick install
   b. can be installed in almost any soil, even rocky soil,
   c. can be installed very quickly and easily without any required digging or concrete use
   d. will be sturdy, strong, lasting
   e. will not end up crooked or leaning because of rocks in the soil below redirecting the portion driven into the ground.
2. To provide a fence post holder base that can be easily and quickly removed and/or relocated.
3. To provide a fence post holder base that can be installed on variously angled slopes while keeping a fence post vertically aligned.

Introduction of this product to the industry is expected to fully disrupt the current market world-wide and use of this product in new and old construction in residential and commercial buildings is expected to provide very substantial savings in time, money and labor to the builders/developers/owners of said properties.

BACKGROUND OF THE INVENTION

1. Field of the Invention

The present invention generally relates any fence that requires one or more fence posts to hold the fence sections in place and attached to each other, whether for temporary or permanent fences.

2. Description of Related Art

Current and related art requires a lot of time and labor and substantial expense. These designs include a post with no base or other attachment, the post being partially buried into the ground or in concrete that has been placed in the ground. Both of these designs requires a lot of manual labor such as digging, filling and tamping dirt or mixing and pouring concrete after digging a hole. These designs also require substantial amounts of time and expense and for all intents and purposes leaves the fence post permanently placed. Another related art is a fence post base with a large spike permanently attached its bottom, wherein the base is driven into the ground until the spike is fully embedded and if the spike hits a rock or other obstruction it will cause the final angle of the fence post to be off kilter. Additionally, driving it into the ground takes a lot of hard physical labor with a sledge hammer and placing a block of wood inside the post clamp portion. Lastly, the process of pounding the post base into the ground can damage and malform the base or the clamp. A third form of related art is a fence post base with a large screw spike for its bottom that is screwed into the ground with the attached post clamp and if it hits a rock will cause the final angle of the fence post to be off kilter. This also require substantial strength and can be exhausting. All of these forms of related art require a lot of labor time and expense and none of them is feasibly moveable after installation. This invention provides a system for installing posts to the ground quick and easily but in such a fashion that they can be easily removed and replaced in a different location quick rapidly and with little effort.

SUMMARY OF THE INVENTION

The technology disclosed is directed toward fencing, but more particularly quick-install, modular fence post base and movable fence post base but could be used for any kind of post.

The current technology includes a substantial digging, placement of the post in the ground and then refilling with either soil, sand or concrete or hard driving a stake or screw manually into the ground. This requires a great deal of labor and time and the post will often rot out faster when buried into the ground because it is partly in the ground where moisture, microbes and pests have more substantial access than above the ground. Driving or screwing a fence post holding base into the ground is particularly problematic because as the fence post holding base is driven into the ground (whether it has a spike or a screw bottom) it often hits rocks that redirect it and you end up with a fence post that is turned or tipped in an undesirable direction. Additionally, the base can be damaged during the process. Additionally, once driven in they are difficult to remove and relocate if desired. Lastly, these such current fence post holding bases are small in diameter and so are not very strong against pressures placed on the fence post by wind, cattle, etc. One particular feature that is different about this present invention is that the screws are independently driven into the ground so that if they change pitch it does not affect the pitch of the base.

We start with a platform called the "base". This is reinforced metal or graphene. At its center on top is the clamping post holder and on the bottom are the threaded screw spikes. Place the platform on the ground in the desired place and turn the center spike until it is screwed completely into the ground and the platform is resting on the ground. Then you take a one or more threaded spikes and screw them into the ground as you pass them through holes in the platform near the edge, such as in the corners on the square version of this invention. These threaded spikes are equipped with a large bolt head on the top to enable the use of a powered tool to turn them into the ground. An option for this invention is to manufacture the platform a little thicker and with holes throughout it to enable grass to grow up through it to make it blend in with the grass of the yard. The threaded screws have a point on the bottom with threads more angled and less pronounced than in the rest of the screw above so that the point and penetrate the soil quickly and easily while the upper part of the screw grabs hold of more soil. The benefit of this design is that, unlike existing fence post holder bases that can be screwed or driven directly into the ground this one will not be twisted or tipped when the screw or spike part hits a rock spikes can sit in the soil at different angles than 90 degrees to the base. The platform being wide also provides for significantly more stability to the fence post.

Since I do not have a prototype yet on this part I cannot provide a video showing installation. The best option is for us to have a video conference in which I describe the process online using the drawings and pointers. For more information please contact Tom Haskins at 508-922-1909 or tom@geninvent.com

DETAILED DESCRIPTION OF DRAWINGS

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout. Unless otherwise noted in this specification or in the claims, all of the terms used in the specification and the claims will have the meanings normally ascribed to these terms by workers in the art.

Figure 1:
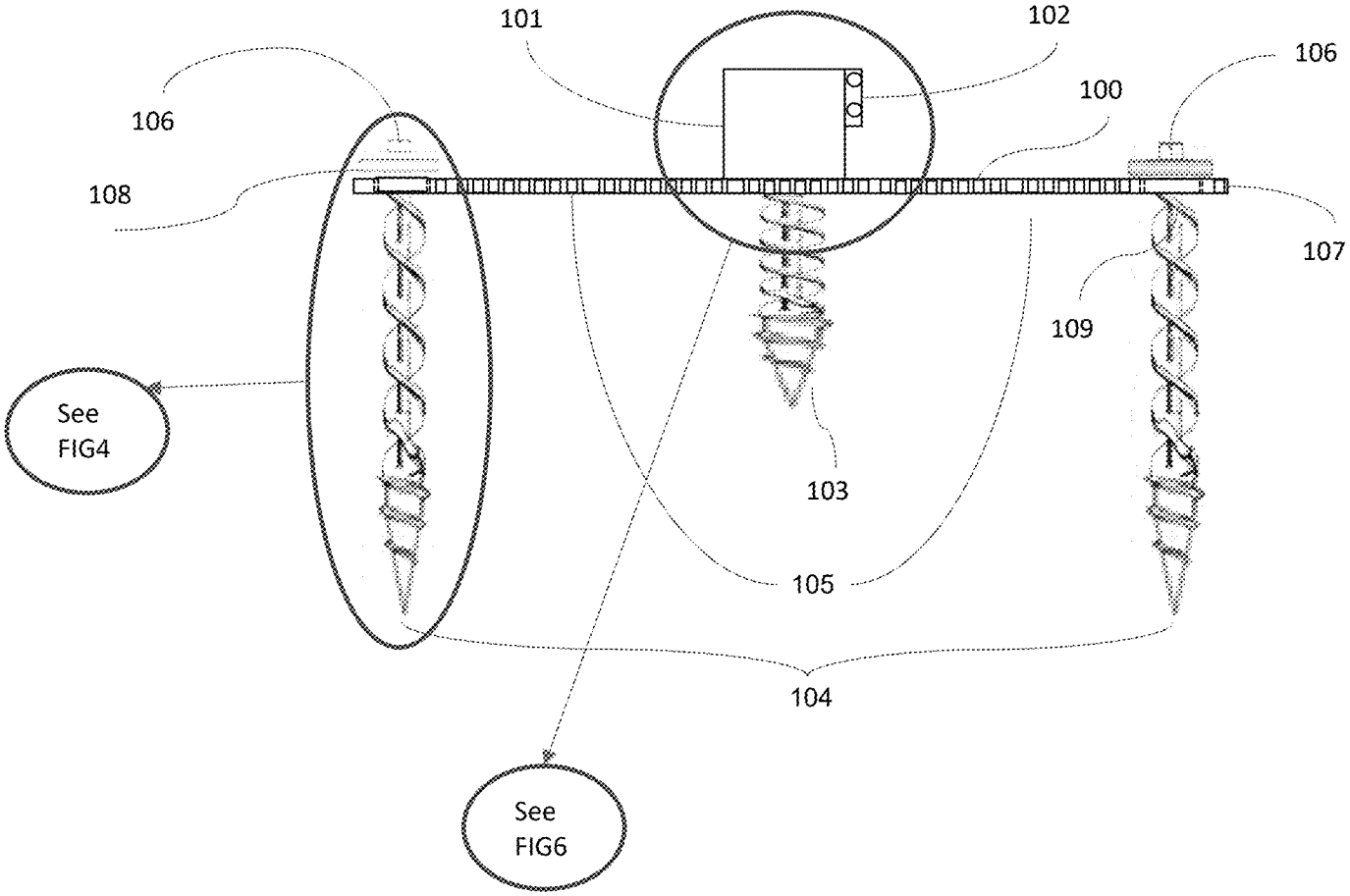
FIG. 1 illustrates a schematic diagram of a side view of the base, fence post holding clamp, the clamping bolts, threaded center spike, 2 perimeter threaded anchor spikes and multiple grass holes.

FIG. 1 illustrates a schematic diagram of a side view of the base 100, fence post holding clamp 101, a plurality of clamping bolts 102, threaded center spike 103, a plurality of perimeter soil-grabbing screw 104, a plurality of perimeter soil-grabbing screw shaft tops 109, a plurality of screw base-holding lips 108, a plurality of grass holes 105 and a plurality of perimeter threaded anchor spike bolt heads 106. The invention is placed on the ground at the desired spot and rotated, screwing the threaded center spike 103 into the ground as the user presses down. Once the base 100 is firmly resting on the ground the user places each of the perimeter soil-grabbing screws 104 in one of the screw holes 107 in the base and using a socket and either a ratchet or a power tool drives the perimeter soil-grabbing screw 104 into the ground by turning it. If the perimeter threaded anchor spikes 104 are redirected by a rock they will not tip, move or tilt the base 100 because they are independent from the base. As the perimeter soil-grabbing screws 104 approach full installation through a plurality of screw holes 107 their perimeter soil-grabbing screw shaft top 109 will fit snugly into the screw holes 107, Once the perimeter soil-grabbing screws 104 are screwed completely into the base 100, the base-holding lip 108 will hold their respective sections of the base 100 firmly to the ground. Once installed, if the user desires to remove or relocate the entire invention they simply unscrew the perimeter soil-grabbing screws 104, turn the base 100 the opposite direction from when they installed it and repeat the process above at another location to reinstall it. The plurality of grass holes 105 allow for grass to grow through the base and camouflage it from site for a more pleasing look.

Figure 2:
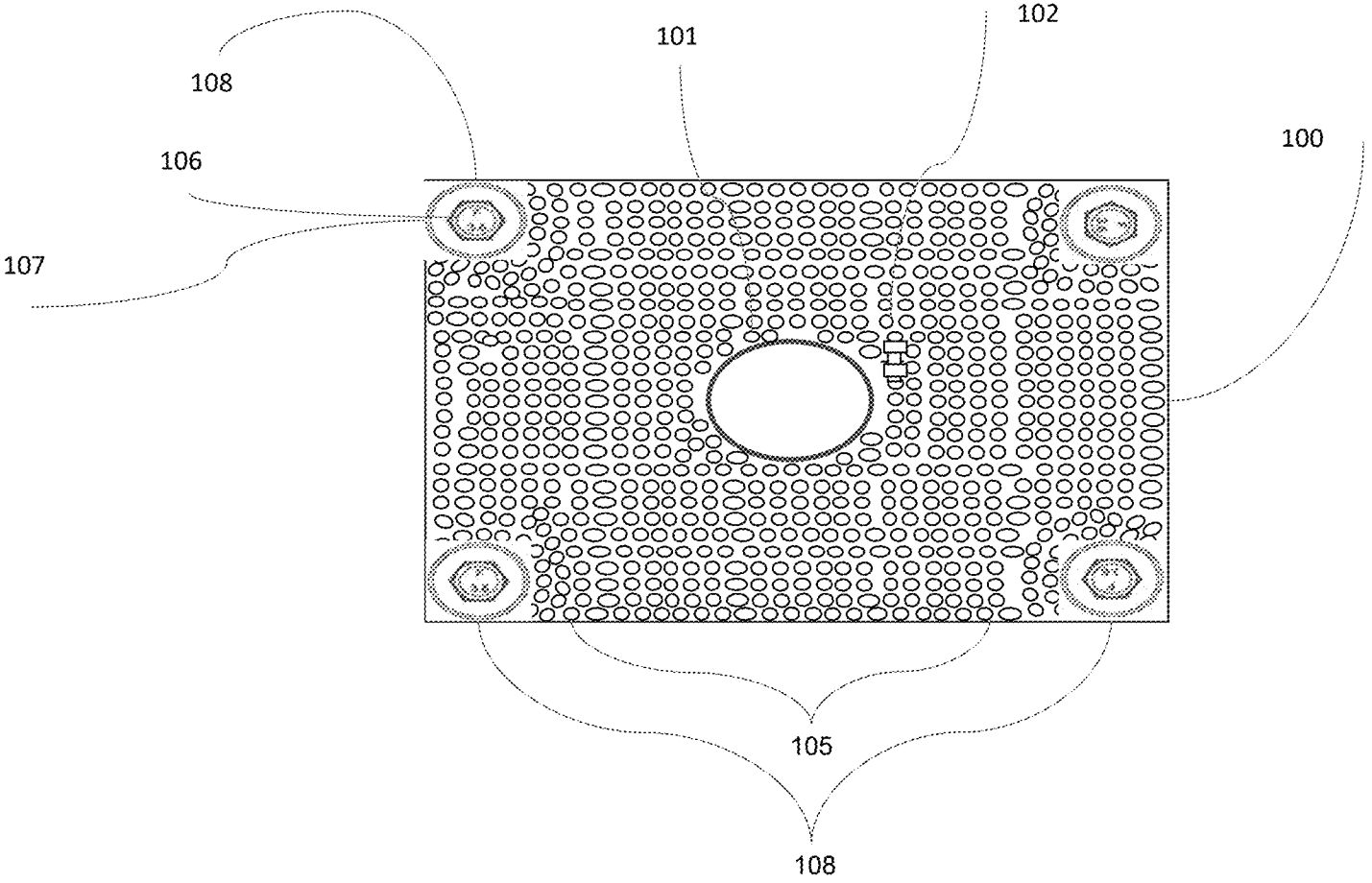
FIG. 2 illustrates a schematic diagram of a top view of a square or rectangular version of this invention with the fence post holding clamp, the clamping bolts, 4 perimeter threaded anchor screws and multiple grass holes.

FIG. 2 illustrates a schematic diagram of a top view of version of this invention with a square or rectangular base 100, the fence post holding clamp 101, a plurality of clamping bolts 102, a plurality of perimeter soil-grabbing screw base-holding lips 108, a plurality of perimeter soil-grabbing screw bolt heads 106 and a plurality of grass holes 105. The plurality of grass holes allow for grass 105 to grow through the base and camouflage it from site for a more pleasing look.

Figure 3:
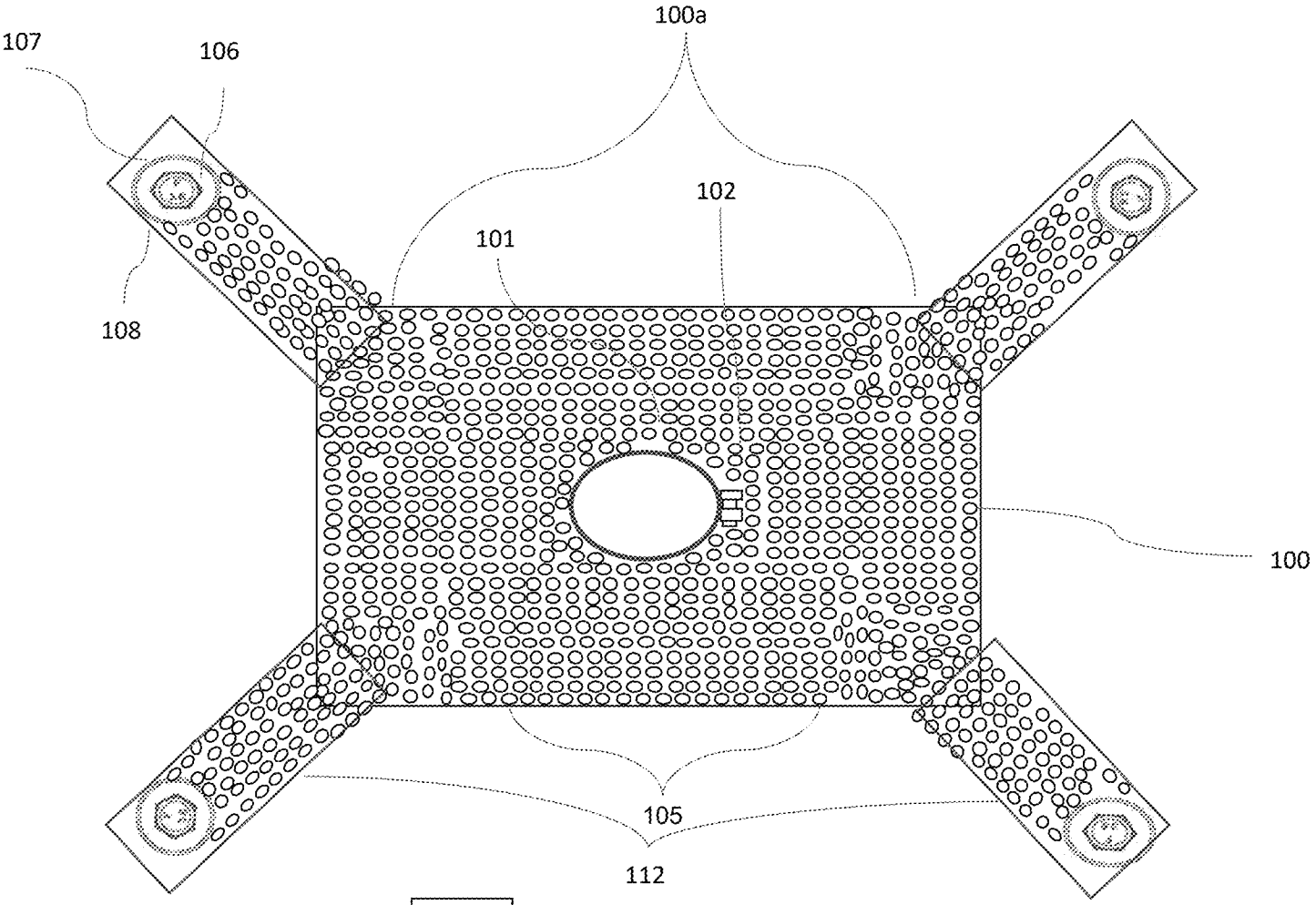
FIG. 3 illustrates a schematic diagram of top view of a square or rectangular version of this invention but with out-cropping base extensions manufactured into the base to provide additional stability, fence post holding clamp, the clamping bolts, 4 perimeter threaded anchor spikes and multiple grass holes.

FIG. 3 illustrates a schematic diagram of a top view of version of this invention with a square or rectangular base 100, 4 base legs 125, the fence post holding clamp 101, a plurality of clamping bolts 102, a plurality of perimeter soil-grabbing screw bolt heads 106, a plurality of perimeter soil-grabbing screw base-holding lips 108 and a plurality of grass holes 105. The plurality of grass holes allow for grass 105 to grow through the base and camouflage it from site for a more pleasing look. The difference in this design is that it includes a plurality of perimeter extensions 112, being made in one potential form of said base plate of a multiple of plates 112*a* manufactured into the base 100, extending its dimensions substantially to provide greater stability.

Figure 4:
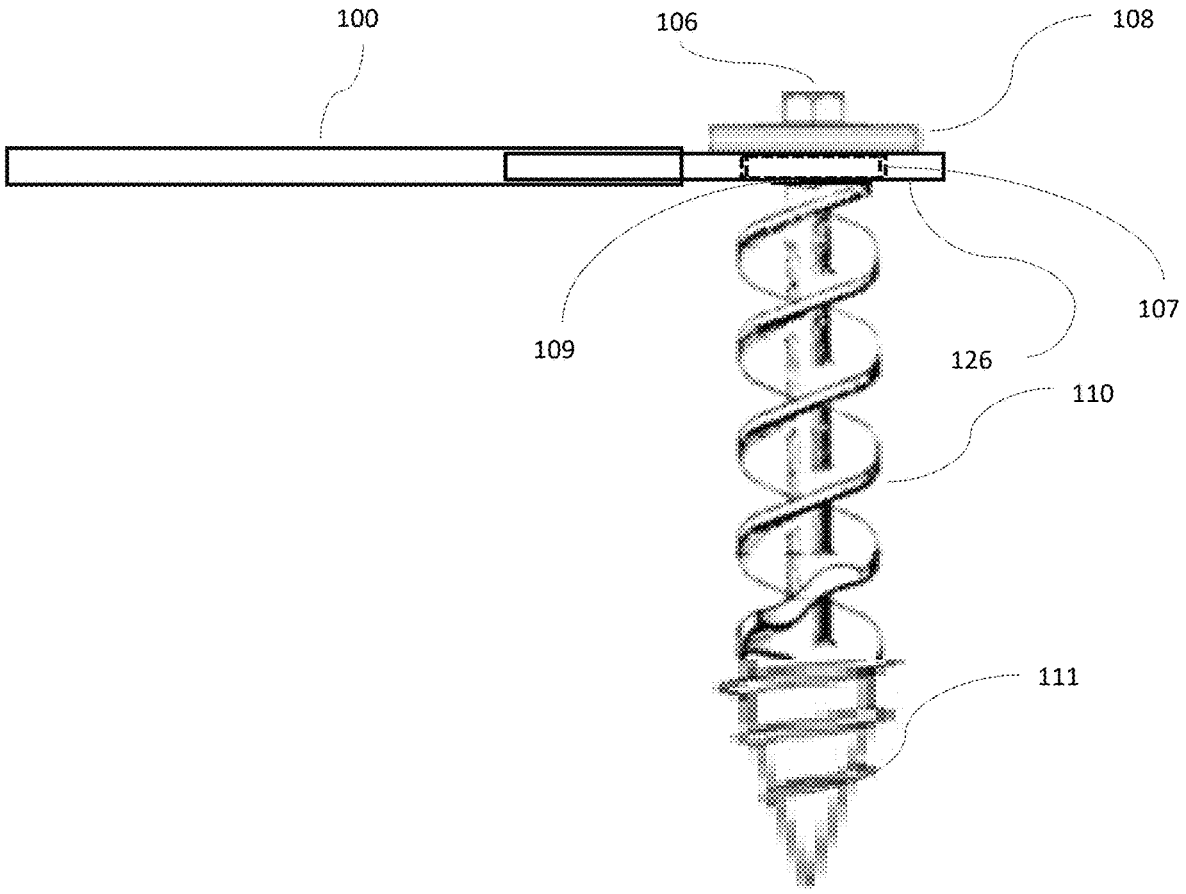
FIG. 4 illustrates a schematic diagram of a detail of the threaded soil-grabbing screws with a bolt head shaped to receive a sock to drive it into or screw it out of the coil quickly and easily, the screw base-holding lip that holds the base firmly to the ground, the screw hole in the base for receiving the screw as it is installed into the ground, the unthreaded shaft of the screw inside the screw hole, the main part of the screw shaft with large and wide threads to provide maximum soil-grabbing benefit and the threaded tip of the screw that is pointed and has finer, less pronounce threads to allow it to penetrate the soil more quickly and easily.

FIG. 4 illustrates a schematic diagram of a detail of the perimeter soil-grabbing screw 104 installed through the screw hole 107 of a base leg 125, with a perimeter soil-grabbing screw bolt head 106 to receive a socket to drive it into or unscrew it from the soil quickly and easily, the screw base-holding lip 108 that holds the base 100 firmly to the ground, the screw hole 107 in the base for receiving the perimeter soil-grabbing screw and the perimeter soil-grabbing screw shaft top 109 as the are installed into the ground, the perimeter soil-grabbing screw threads 110 with large and wide threads to provide maximum soil-grabbing benefit and the perimeter soil-grabbing screw soil-piercing threads and point 111 with less pronounced threads to allow it to penetrate the soil more quickly and easily. FIG. 4 also highlights the feature of an option to this invention that includes a plurality of base legs 125 with base leg extensions 126 which allow for the base legs 125 to be lengthened or shortened according to the preferences of the user, the demands of the terrain and the presence of obstacles.

Figure 5:
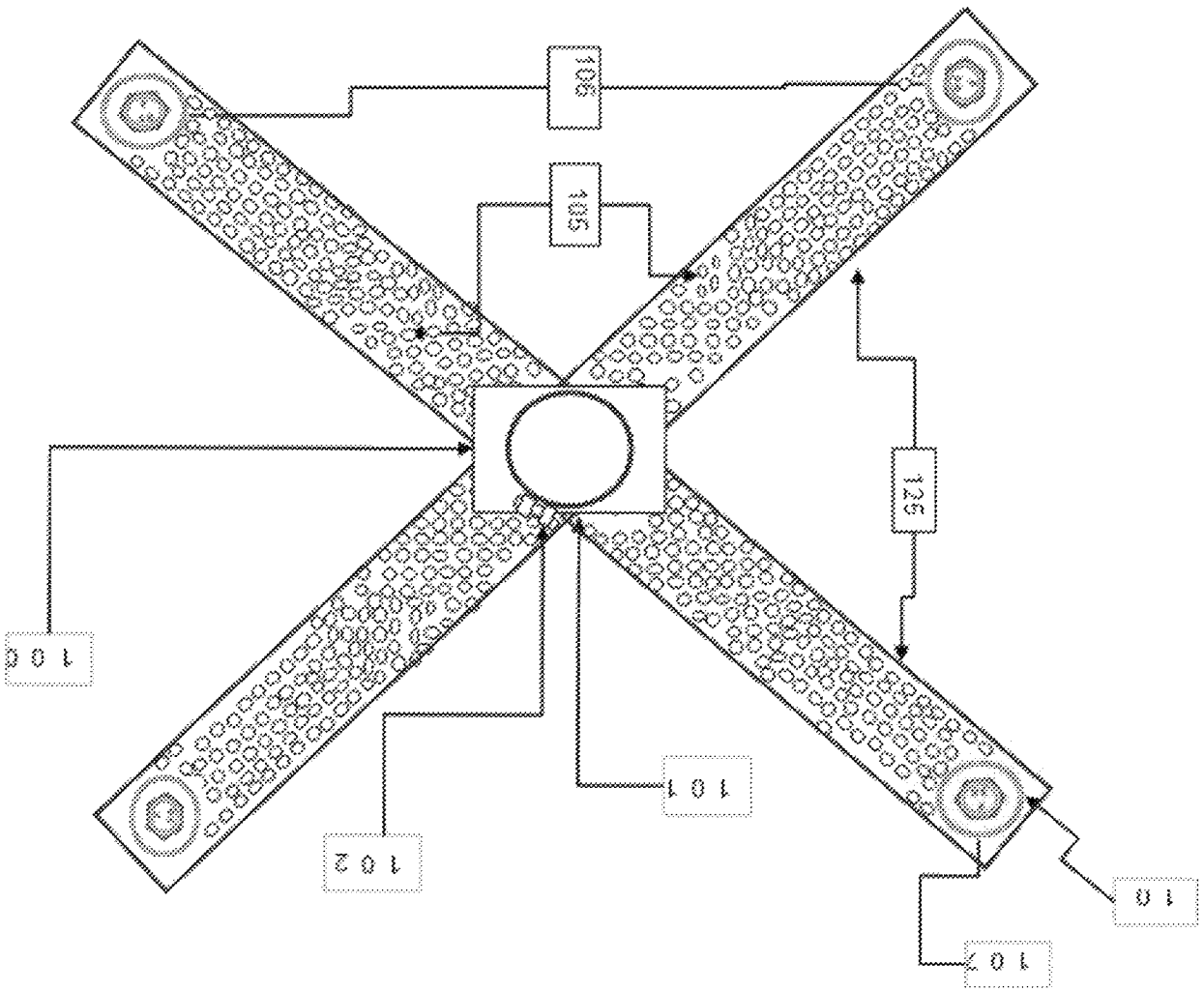
FIG. 5 illustrates a schematic diagram of top view of X-shaped version of this invention to provide a base with added footprint size and stability that covers less grass and requires less material to manufacture; having a base, fence post holding clamp, the clamping bolts, 4 perimeter threaded anchor spikes and multiple grass holes.

FIG. 5 illustrates a schematic diagram of top view of a version of this invention with an X-shaped base 100 having 4 base legs 125 which provides added footprint size and stability but covers less grass, requires less material to manufacture and may be installed around obstacles such as rocks and trees without reducing footprint size; having a base 100, fence post holding clamp 101, a plurality of clamping bolts 102, a plurality of perimeter soil-grabbing screw 104, a plurality of grass holes 105, a plurality of perimeter soil-grabbing screw bolt heads 106, a plurality of screw holes 107 and a plurality of screw base-holding lips 108

Figure 6:
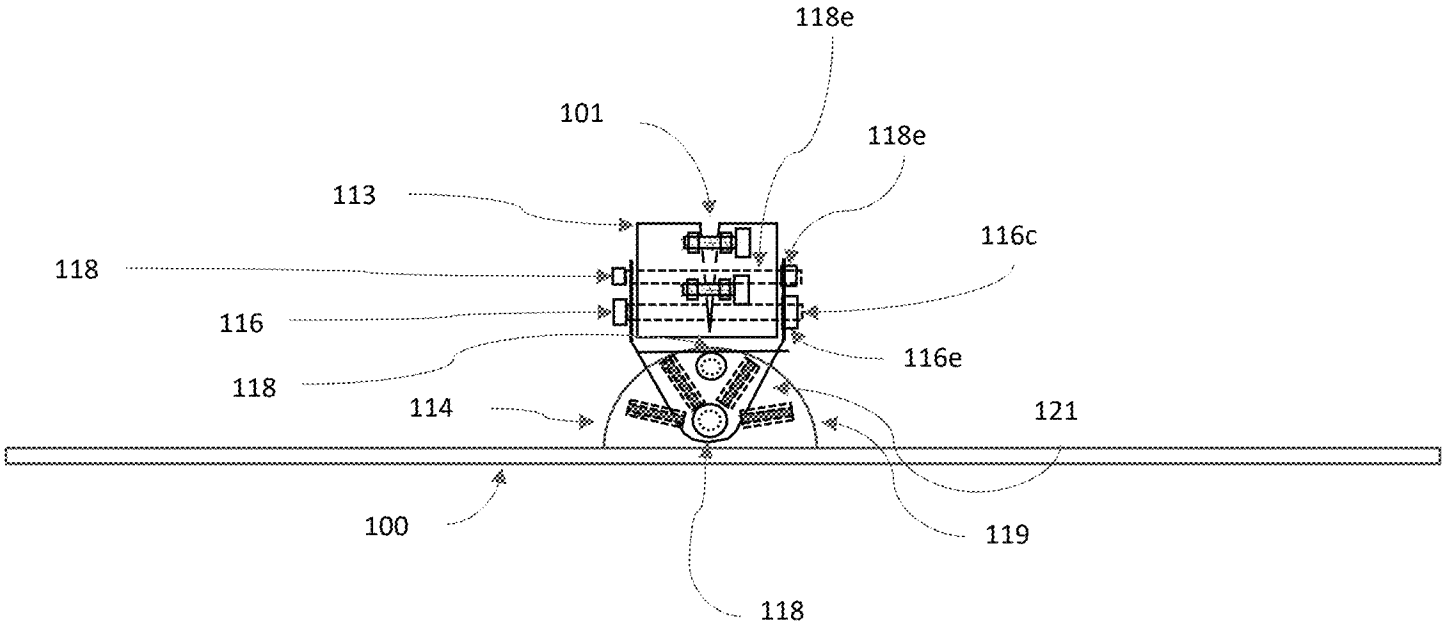
FIG. 6 Illustrates a schematic diagram of a detail of an optional feature of this invention that allows the user to tilt the fence post clamp, and thereby the fence post, in one direction and clamp it in such position. This allows for installation on sloped and hill ground and mountainsides. This design feature includes three independent fence post clamp pivot brackets, the primary pivot bracket, the secondary pivot bracket and the base pivot bracket. The primary pivot bracket wraps around the fence post clamp and is attached to it with a pivot bolt and a pivot top bolt. The secondary pivot bracket wraps around the primary pivot bracket and is attached to it with a pivot bolt and a pivot top bolt. In both cases the pivot top bolt action is supported by the pivot stop bars which consist of male bars on the exterior side wall of the fence post base and their matching female bars on the interior side wall of the primary pivot bracket; and male bars on the exterior side wall of the base pivot bracket and the interior side wall of the secondary pivot bracket. This schematic focuses on the relationship between the fence post clamp and the primary pivot bracket.

FIG. 6 Illustrates a schematic diagram of a detail of this invention revealing how a user will be able to tilt said fence post holding clamp, and thereby said fence post, in one or both of two directions and clamp it in such position. This allows for installation on sloped and hilly ground and mountainsides such that said fence post remains vertical. This design feature includes two independent pivot brackets, said base pivot bracket 121 and said secondary pivot bracket 113. Said base pivot bracket 114 is attached to said base plate(s) 100 having two vertical plates 119 with rounded top edges 119*a* (shaped in a half circle) to receive said secondary pivot bracket 115, having a hole in each plate bottom 116*a* (aligned with each other) to receive said pivot bolt 116 and a hole in each plate upper 118*a* (aligned with each other) to receive said pivot stop bolt 118. As said secondary pivot bracket 115 is pivoted on said base pivot bracket 114 and when brought to desired pivot position, said pivot bolt 116*c* and said pivot stop bolt 118*c* are tightened with their respective nuts 116*d* and 118*d*. Said secondary pivot bracket 115 is inserted between said base pivot bracket 114 two said vertical plates 119, and having two vertical plates of its own 115*b* with rounded top edges to receive said fence post clamp 113, a hole in each plate (aligned with each other) to receive said pivot bolt 116*c* and a hole in each plate upper wall (aligned with each other) to receive said pivot stop bolt 118*c*. As said fence post clamp 113 is pivoted on said secondary pivot bracket 115 and is brought to desired pivot position, said pivot bolt 116*c* and said pivot stop bolt 118*c* are tightened with their respective nuts 116*d* & 118*d*. Therefore, said base pivot bracket 114 and said secondary pivot bracket 115 are designed identically in their function and operation. This schematic focuses on the relationship between the base pivot bracket 114 and the secondary bracket 114.

Figure 7:
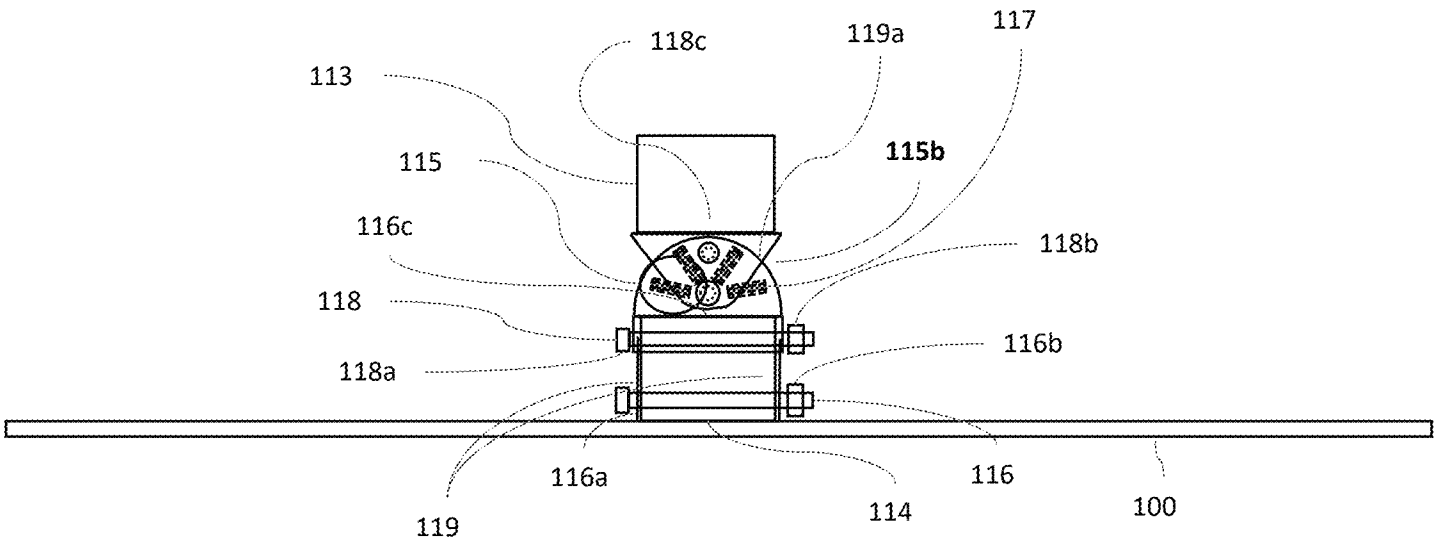
FIG. 7 Illustrates a schematic diagram of a detail of an optional feature of this invention that allows the user to tilt the fence post clamp, and thereby the fence post, in one or more direction that are marginally perpendicular to the direction provided for in FIG. 6 and clamp it in place in such position. This feature allows for installation on sloped, hill ground and mountainsides. Said design feature includes two independent fence post clamp pivot brackets, the base pivot bracket and the secondary pivot bracket. The base pivot bracket connects to the fence post clamp and is attached to it with a pivot bolt and a pivot stop bolt. The secondary pivot bracket connects to the fence post clamp and is attached to it with a pivot bolt and a pivot stop bolt. In both cases the pivot stop bolt action is supported by the pivot stop bars which consist of male bars on an exterior side wall of both said secondary pivot bracket and said fence post base, respectively, and their matching female bars on an interior side wall of said base pivot bracket and secondary pivot bracket, respectively; wherein said male bars and said female bars align with each other. This schematic focuses on the relationship between the secondary pivot bracket and the base pivot bracket.

FIG. 7 Illustrates a perpendicular side view of FIG. 6 illustrating said pivot and clamping action of said secondary pivot bracket on said fence post clamp.

Figure 8:
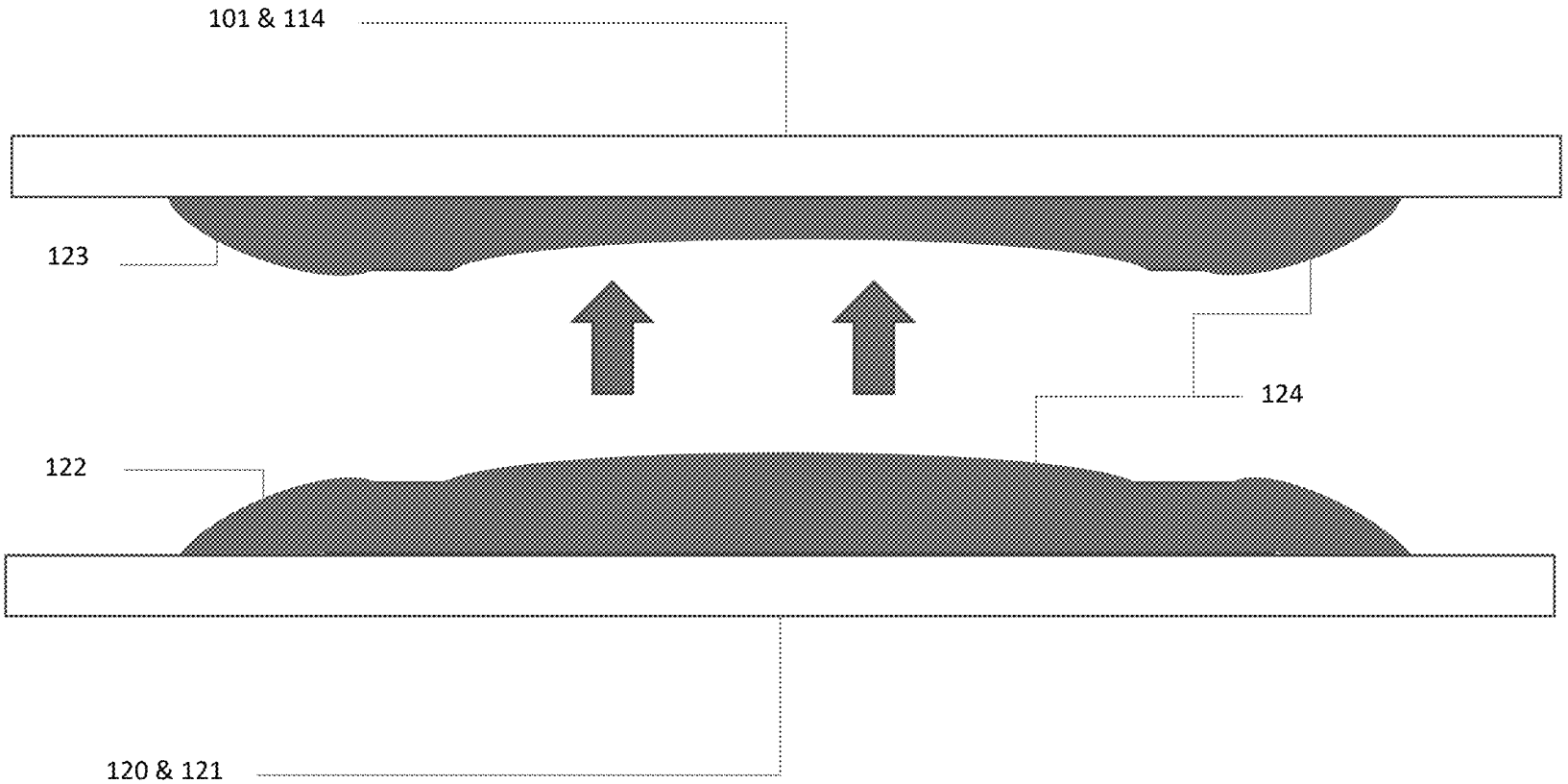
FIG. 8 Illustrates a schematic diagram of a detail of pivot stop bars located on the exterior side wall of the fence post clamp and interior side wall of the primary fence post clamp holding clamp and on the interior side wall of the secondary fence post clamp and exterior side wall of the pivot bracket.

FIG. 8 Illustrates a schematic diagram of a detail of the pivot stop bars located on the exterior side wall of the fence post clamp 101 and interior side wall of the primary pivot bracket top section 120 and on the interior side wall of the base pivot bracket 114 and the exterior side wall of the primary pivot bracket bottom section 121, respectively. As the primary pivot stop bolt 117 and secondary pivot stop bolt 118 are tightened they force these male pivot stop bars 122 and female pivot stop bars 123 to mesh together 124, preventing further pivoting.

These and other changes can be made to the invention in light of the above detailed description. In general, the terms used in the following claims, should not be construed to limit the invention to the specific embodiments disclosed in the specification, unless the above detailed description explicitly defines such terms. Accordingly, the actual scope of the invention encompasses the disclosed embodiments and all equivalent ways of practicing or implementing the invention under the claims.

The invention claimed is:

1. A post-holding base adapted to be quickly and easily installed, uninstalled and relocated, the post-holding base comprising:

at least one substantially rigid base plate, the base plate having a base top, a base bottom, at least one base side and the base top having a base center;

a rotatable mount including a primary pivot mount having a primary bottom, a primary pivot and a primary axis, the primary pivot mount attached to the base top at the primary bottom and a primary pivot pivotable about the primary axis;

the rotatable mount further including a secondary pivot mount having a secondary bottom, a secondary pivot and a secondary axis, the secondary pivot mount attached to the primary pivot at the secondary bottom and a secondary pivot pivotable about the secondary axis;

wherein the secondary pivot mount is attached to the primary pivot such that the secondary axis and the primary axis are substantially perpendicular to each other;

a primary locking mechanism and a secondary locking mechanism for respectively and selectively preventing the primary pivot and secondary pivot from pivoting about the primary axis and the secondary axis;

a post clamp mounted to the secondary pivot, the post clamp configured to receive a bottom end of a post;

a plurality of clamping bolts selectively attachable to the post clamp for locking the post within the post clamp; and, a removable screw configured to anchor the post clamp to a ground through the base plate.

2. A post-holding base according to claim 1 wherein the post clamp includes a first side and a second side and at least one of the plurality of clamping bolts passes through the first side of the post clamp and through the second side of the post clamp.

3. A post-holding base according to claim 1 wherein said base pivot mount and said secondary pivot mount have pivot stop bars which consist of male bars on and exterior side wall of each said base pivot mount and said secondary pivot mount and matching female bars on and interior side wall of said base pivot mount and said secondary pivot mount.

4. A post-holding base according to claim 1 wherein said base having a least one hole to allow grass to grow through.

* * * * *